US005501522A

United States Patent [19]

Tung

[11] Patent Number: 5,501,522

[45] Date of Patent: Mar. 26, 1996

[54] MULTIPLE ROTATION MATERIALS PROCESSOR

[76] Inventor: Lin C. Tung, Suite 1, 11 F. No. 95-8 Chang Ping Rd. Sec. 1, Taichung, Taiwan

[21] Appl. No.: 286,139

[22] Filed: Aug. 8, 1994

[51] Int. Cl.[6] ..... B01F 9/00

[52] U.S. Cl. ..... 366/219; 366/149; 475/219; 475/221

[58] Field of Search ..... 366/101, 105, 366/107, 149, 208, 209, 213, 217, 219, 220, 232; 475/5, 219, 221, 336

[56] References Cited

U.S. PATENT DOCUMENTS

| | | | |
|---|---|---|---|
| 1,011,929 | 12/1911 | Ecaubert | 366/213 X |
| 1,143,268 | 6/1915 | Henderson | 366/219 |
| 1,155,150 | 9/1915 | Henderson | 366/219 |
| 1,292,127 | 1/1919 | Stevens | 366/217 |
| 1,755,763 | 4/1930 | Barber | 366/217 X |
| 2,262,797 | 11/1941 | Chapman | 475/336 X |
| 4,296,882 | 10/1981 | Kobayashi | 366/219 X |
| 4,574,656 | 3/1986 | McCarthy et al. | 475/5 X |
| 5,106,353 | 4/1992 | Ra et al. | 475/336 X |
| 5,151,368 | 9/1992 | Brimhall et al. | 366/220 X |

FOREIGN PATENT DOCUMENTS

| | | | |
|---|---|---|---|
| 2638801 | 5/1990 | France | 475/221 |

*Primary Examiner*—Charles E. Cooley

[57] ABSTRACT

A multiple rotation materials processor for trituration or mixing of materials comprises a first and second coupled differential gear assemblies rotatingly positioned on a mount, and an outer container rotatingly coupled to a first differential gear assembly containing an inner container in which processants to be triturated or mixed are stored. A first motor fixed to the mount rotates the coupled gear assemblies about a first axis wherein the outer container revolves thereabout. A second motor fixed to an opposite side of the mount, and cylinder container mounted on the rotating second gear assembly and effected by a second axis perpendicular to the coupled rotation of the gear assemblies. A gas conduit leads into a space within the outer container surrounding the inner container whereby the ambient temperature and pressure of the processant can be controlled.

2 Claims, 4 Drawing Sheets

MULTIPLE ROTATION MATERIALS PROCESSOR

BACKGROUND OF THE PRESENT INVENTION

The present invention relates to a processor for triturating or mixing materials, and more particularly to a multiple rotation materials processor having a processing chamber which rapidly rotates about a pair of perpendicular axes.

Granular or liquid mixtures are efficiently triturated and/or mixed in a rapidly rotating chamber, wherein the chamber rotates about perpendicular and non-coincident axes so as to provide rigorous gyro forces on the processant, effecting a rapid and thorough abrasive or mixing action.

Further, the mixing or trituration chamber is disposed within an outer chamber, where in a gaseous mixture can be egressed into the space therebetween so as to enable control over the temperature and pressure of the processant.

SUMMARY OF THE PRESENT INVENTION

The multiple rotation materials processor of the present invention comprises a pair of coupled and coaxial motor driven differential gear assemblies, and a revolving outer container coupled to a first differential gear assembly. The outer container revolves about a first axis driven by a first motor coupled to the first differential gear assembly, and rotates about perpendicular second axis driven by a second motor coupled to the second differential gear assembly. Processants are stored within an inner container disposed within the outer container, with an ambient space defined therebetween. A gaseous mixture can be intromitted into the space via a conduit traversing the first and second axes of rotation of the processor, so as to facilitate reverible rotation and control of the temperature, pressure, and parameters of the processant.

The multiple rotation materials processor of the present invention has as a main object to provide a materials processor for trituration or mixing of processant as characterized which effects a rigorous and uniform agitation to the processant.

A further object of the present invention is to provide a multiple rotation materials processor as characterized which enables and facilitates control of the ambient temperature and pressure during processing.

DETAILED DESCRIPTION OF THE PREFERRED EMBODIMENT

Figure 1:
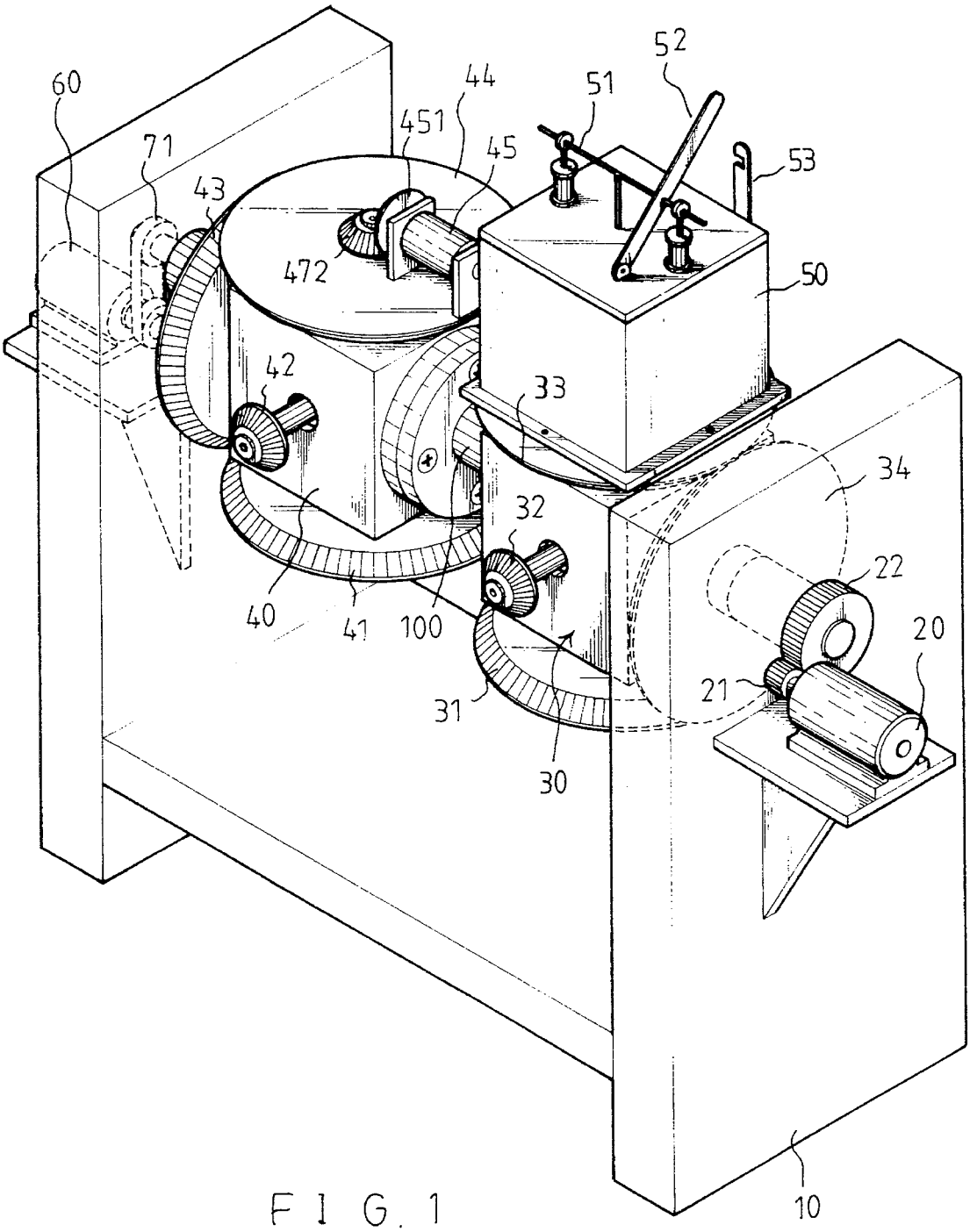
FIG. 1 is a perspective view of the multiple rotation materials processor of the present invention.
Figure 2:
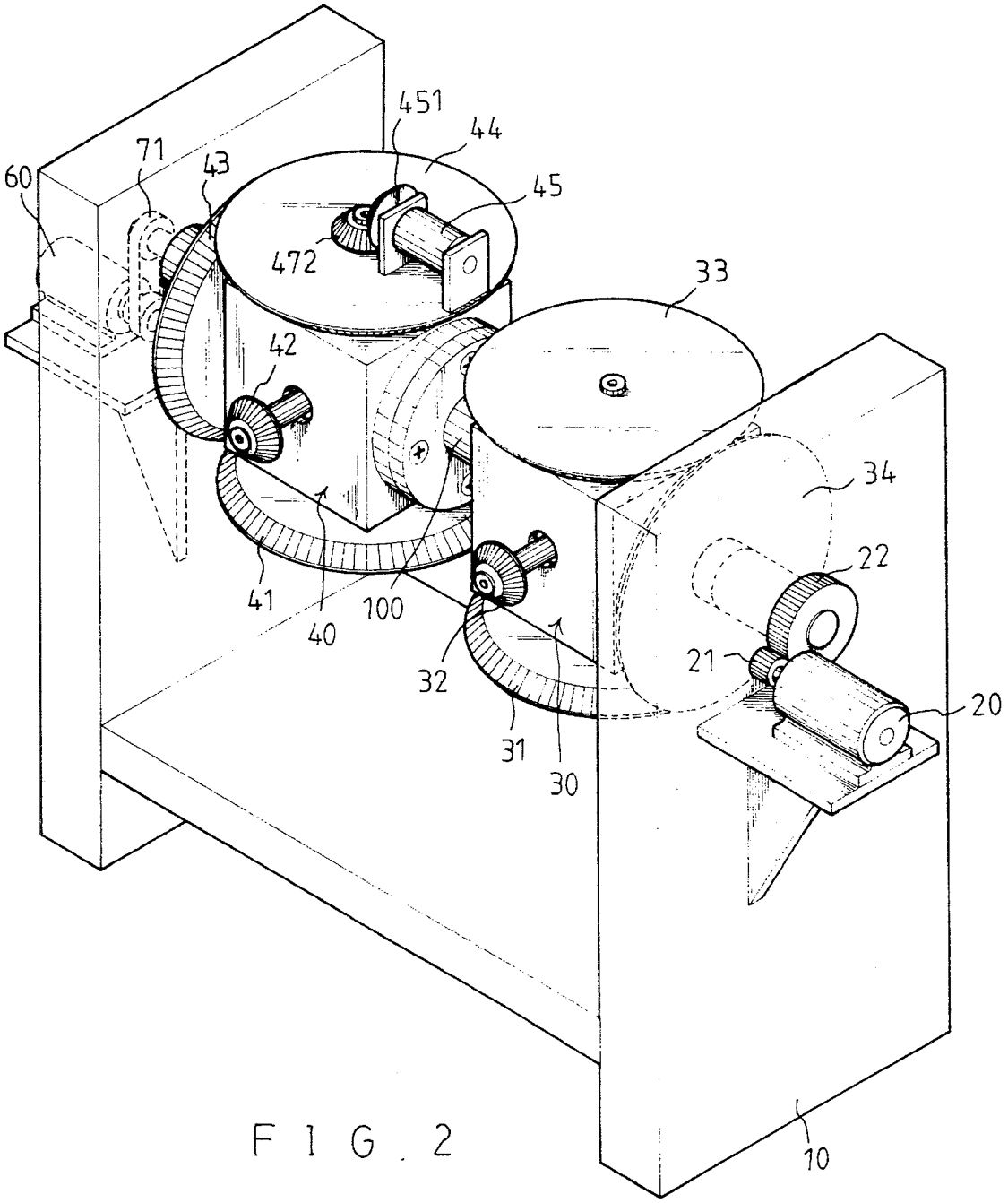
FIG. 2 is a perspective view as in FIG. 1, with an outer container containing the processing chamber removed.
Figure 3:
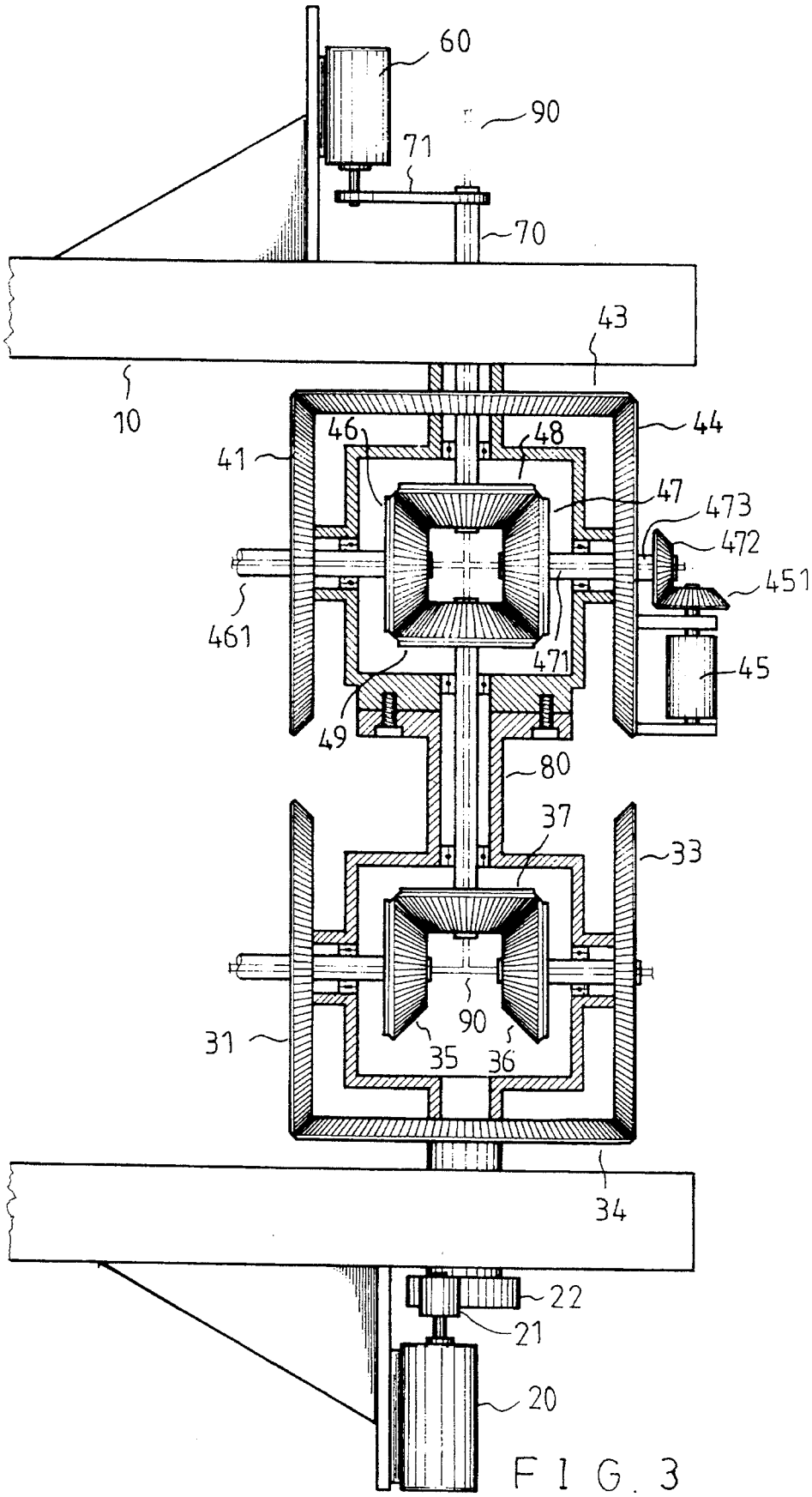
FIG. 3 is a side view of the multiple rotation materials processor showing the arrangements of gears therein.

Referring to FIGS. 1 to 3 of the drawings, the multiple rotation materials processor generally comprises a pair of co-axial differential gear assemblies 30 and 40, fixedly coupled by a first axle journal 100 and rotatingly secured to a frame 10, and an outer container 50 rotatingly coupled to the first assembly 30. The first differential gear assembly 30 comprises a pair of aligned external bevel gears 31, 33 engaged with a perpendicular external bevel gear 34. Gear 34 is coupled to a motor 20 on one side of the mount via a pair of gears 21 and 22. The housing of assembly 30 is coupled to gear 34 so that the fixedly coupled assemblies 30, 40 are rotated about their mutual axis by the motor 20.

A pair of internal bevel gears 35 and 36 are disposed within the housing 30 between gears 31, 33 and are co-axial and coupled therewith. Gears 35, 36 are engaged with a bevel gear 37 coupled to the second differential gear assembly 40 via a tubular shaft 80.

The second differential gear assembly 40 similarly has a pair of external bevel gears 41 and 44 which are engaged with an external bevel gear 43 perpendicular therewith. An internal bevel gear 48, co-axial with gear 43, has a shaft 70 which extends through the mount to couple with a second motor 60 via a belt or chain 71. Gear 48 is engaged with further internal bevel gears 46 and 47, co-axial with respective gears 41 and 44. Gears 46, 47 in turn are engaged with an internal bevel gear 49 which has a common shaft 80 with gear 37. A cylinder container 45 is mounted on the outer face of gear 44 at a radial orientation for processing particulate solids therein, and is coupled to the shaft 471 of gear 47 via a pair of bevel gears 451 and 472. Shaft 471 is rotatably secured to a second axle journal 473 at the center of the bevel gear 44 and fixedly coupled with a less diameter bevel gear 472.

Figure 4:
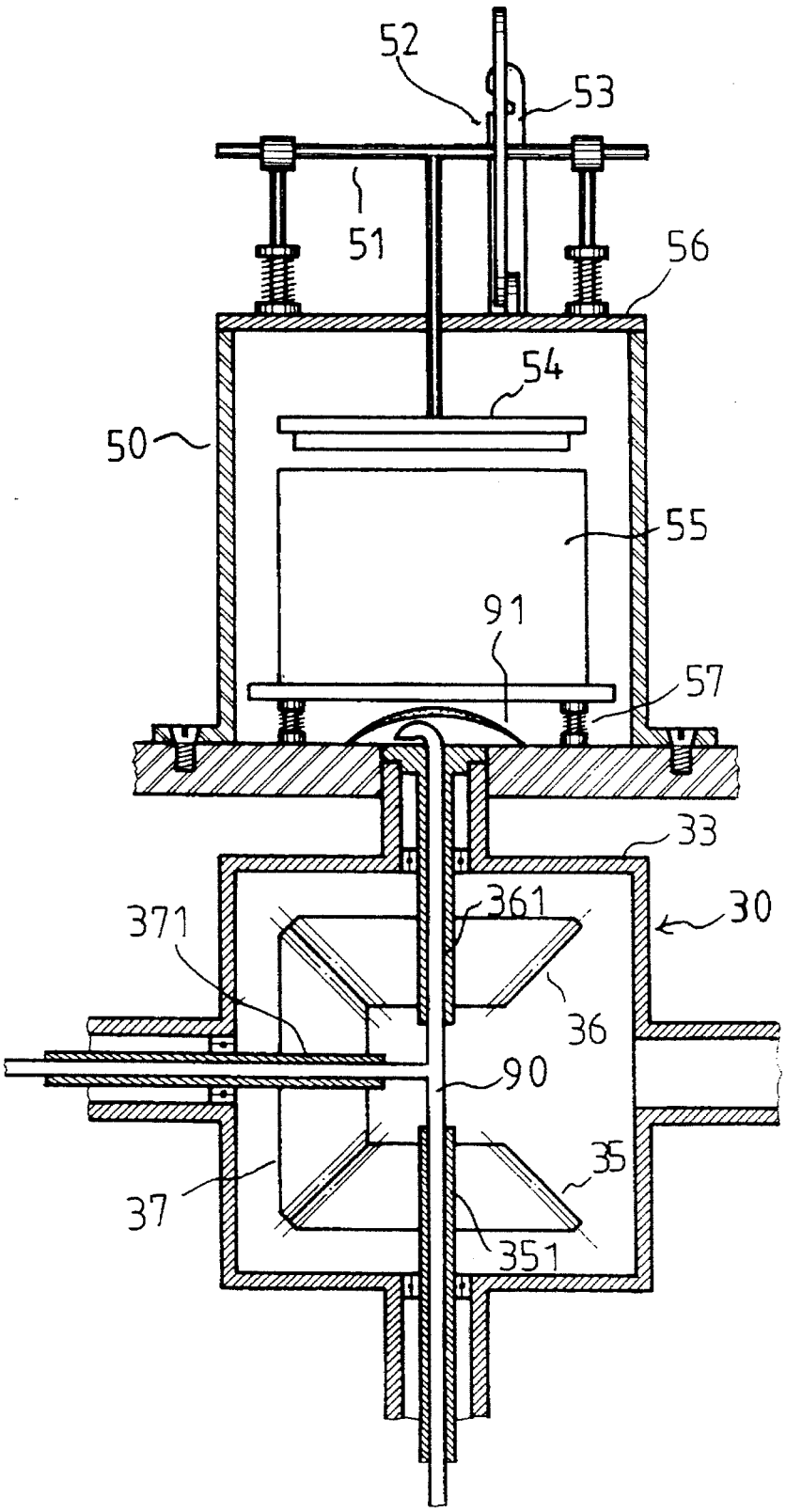
FIG. 4 is a sectional view showing the outer container, an inner container housing the processing chamber, and gas conduits leading into the space therebetween.

Referring also to FIG. 4, a boxlike outer container 50 is fixedly coupled to gear 33 so as to rotate therewith. Within the outer container is an inner container 55, as shown in FIG. 4, for storing processant in a processing chamber therein. The processing chamber is accessed via a lid 54 covering the top of the inner container 55. A spring biased plunger 51 is fixed to the top cover 56 of the container 50 and extends therethrough to join with lid 54. A lever 52 is hingedly connected to the top cover 56 and is engaged with the plunger 51 so as to depress it downwards when pivoted, wherein the lid 54 is pushed against the inner container 55. The lever engages a catch bar 53 to releasably secure in place the lid over the inner container 55. A surrounding space is defined between the inner and outer containers 55 and 50, wherein the inner container 55 is resiliently mounted within the outer container 50 upon two pairs of spring supports 57.

A gas conduit 90 extends through the center of the shafts 361, 351 and 371 of gears 36, 35 and 37. The branches of the conduit extend through the shafts 461 and 471 of gears 46 and 47. The gas conduit 90 extends through the bottom of the outer container 50 and into the space between the inner container 55 and the outer container 50. A filter 91 guards the egress or ingress of gas into the space preventing particulate matter from traveling through.

In operation, a processant comprising liquids or particulate solids to be mixed, or a solid substance or object with an abrasive admixture for trituration, is placed within the processing chamber of container 55. Prior to the closing of lid 54 thereagainst the gaseous pressure or composition in the ambient space surrounding the processing chamber can be adjusted or controlled by removal or injection of air or other gaseous mixture therein via conduit 90. Temperature within the chamber can likewise be controlled by heating or cooling of the gas sent through the conduit 90. Processing can commence upon closure and securement of the lid 54 over container 55, wherein motor 20 effects the rotation of the housing of the two gear assemblies 30 and 40, so that container 50 revolves about the vertical axis of rotation. Motor 60 effects the rotation of gears 43, 48, 46, 47, 49, 35, 36 and 37, wherein the secondary rotation is at a perpendicular axis with respect to that of the primary rotation so that the gear 47 effects the gear 472 and 451 to indirectly activate the cylinder container 45 for vertical rotation. By varying the speed of the motors both the primary and secondary rotation of the containers can be controlled to a fine degree. The strong gyro forces exerted on the processant due to the rapid perpendicularly directed rotations effect an efficient mixing or abrasive, effect within the processing chamber. Large vibratory forces are also generated due to the resilient support of container 55 within the outer container 50. The temperature of the processant during processing can be controlled by sending heated or cooled gas into the space surrounding the inner container 55 via the conduit 90.

Referring again to FIG. 1, a second set of processing containers can be mounted on the under side of the gear 31 opposite from container 50. In yet another variation gears 32 and 42 on the exterior of the housings of gear assemblies 30, 40 which are coupled to the shafts of respective gears 35, 46 can be employed to power gas processors (not shown) mounted on the sides of the respective gear assembly housings which would work to regulate the control gas flowing through conduit 90.

Further modifications and variations could also be accomplished by a person of average skill in the art, and as such the scope of the present invention should not be inferred from the specifications of the above disclosure but should instead be determined from the appended claims.

I claim:

1. A processor for triturating or mixing materials comprises:

a mount;

a first and a second differential gear assembly, each said assembly including a housing fixedly coupled together by a first axle journal therebetween, a first external bevel gear disposed outside each said housing, a second and a third external bevel gear disposed outside each said housing perpendicularly engaged with a respective one of said first external bevel gears, a first internal bevel gear disposed inside each said housing co-axial and coupled with a respective one of said external bevel gears, a second and a third internal bevel gear disposed inside each said housing perpendicularly engaged with a respective one of said first internal bevel gears, with said first internal bevel gear of each said housing having a common shaft therebetween, a fourth internal bevel gear in said housing of said second differential gear assembly perpendicularly engaged with said second and third internal bevel gears thereof;

a first motor fixed to said mount rotatingly coupled to said first and second differential gear assemblies and effecting rotation of said housing of each said differential gear assembly about a first axis;

a second motor fixed to said mount and to said fourth internal bevel gear of said second differential gear assembly effecting rotation of said first, second and third internal bevel gears of said first and second differential gear assemblies about a second axis perpendicular to said first axis;

a cylinder container rotatably fixed to said second external bevel gear on said second differential gear assembly rotatingly coupled to said second internal gear via a pair of less diameter bevel gears thereof;

an outer container coupled to said second external bevel gear of said first differential gear assembly so as to rotate about said first axis;

an inner container having a chamber therein resiliently held in said outer container to rotate therewith, materials to be triturated or mixed being stored in the chamber thereof.

2. A processor for triturating or mixing materials according to claim 1, wherein a surrounding space is defined between said inner container and said outer container, and further comprising a fluid conduit extended along said first axis and said second axis therein to communicate with said space.

* * * * *